US009115469B2

(12) United States Patent
Struck et al.

(10) Patent No.: US 9,115,469 B2
(45) Date of Patent: Aug. 25, 2015

(54) NOZZLE ARRANGEMENT

(75) Inventors: Hans Joachim Struck, Offenburg (DE); Lutz Fabiny, Ortenberg (DE)

(73) Assignee: PAPIERMASCHINEN-SYSTEMTECHNIK GMBH, Offenburg (DE)

( * ) Notice: Subject to any disclaimer, the term of this patent is extended or adjusted under 35 U.S.C. 154(b) by 663 days.

(21) Appl. No.: 13/098,532

(22) Filed: May 2, 2011

(65) Prior Publication Data

US 2011/0266372 A1 Nov. 3, 2011

(30) Foreign Application Priority Data

Apr. 30, 2010 (DE) ..... 10 2010 019 179

(51) Int. Cl.

| | |
|---|---|
| ***B05B 1/34*** | (2006.01) |
| ***D21F 1/34*** | (2006.01) |
| ***B05B 1/16*** | (2006.01) |
| ***B05B 15/06*** | (2006.01) |
| ***B05B 1/14*** | (2006.01) |
| ***B05B 1/20*** | (2006.01) |
| ***B05B 3/02*** | (2006.01) |
| ***B08B 3/02*** | (2006.01) |

(52) U.S. Cl.

CPC ... *D21F 1/34* (2013.01); *B05B 1/14* (2013.01); *B05B 1/16* (2013.01); *B05B 1/20* (2013.01); *B05B 1/34* (2013.01); *B05B 3/025* (2013.01); *B05B 15/065* (2013.01); *B05B 15/069* (2013.01); *B08B 3/02* (2013.01)

(58) Field of Classification Search

CPC ..... B05B 1/34; B05B 3/02; B05B 3/04; B05B 3/025; B05B 1/16; B05B 15/065; B05B 7/1209; B05B 15/069; B05B 1/14; B05B 1/20; D21F 1/34

USPC ..... 239/114, 116, 123, 48, 550, 552, 556, 239/558, 559, 566, 567, 591, 596, 600, 239/DIG. 45, 117, 380, 381, 390, 391, 392, 239/394, 465, 580, 548

See application file for complete search history.

(56) References Cited

U.S. PATENT DOCUMENTS

| | | | | | |
|---|---|---|---|---|---|
| 3,218,227 | A | * | 11/1965 | Moore et al. | 162/275 |
| 4,838,486 | A | * | 6/1989 | Finkbeiner | 239/117 |
| 5,242,113 | A | * | 9/1993 | Manderson | 239/381 |

(Continued)

FOREIGN PATENT DOCUMENTS

| | | |
|---|---|---|
| DE | 202005020149 | 4/2006 |
| DE | 102006007223 | 8/2007 |

*Primary Examiner* — Steven J Ganey

(74) *Attorney, Agent, or Firm* — Volpe and Koenig, P.C.

(57) ABSTRACT

A nozzle arrangement (1) for a high-pressure cleaning or conditioning device of a paper machine having a nozzle body (2), with a first jet channel (3) for liquids impinged with high pressure passing therethrough, with at least one partially penetrating nozzle element (4) being arranged in the jet channel (3), which forms the liquid passing the jet channel (3) into a laminar jet (5). In order to provide a nozzle arrangement (1) increasing the efficiency of the spray tube with a good cleaning result and simultaneously reduced water consumption it is provided that at least one additional nozzle element (4) is located at the nozzle body, which is arranged in another jet channel (3) different from the first jet channel (3) or together with the first and/or another nozzle element (4) in a joint jet channel (3) and that the nozzle body (2) is arranged at the nozzle arrangement (1) rotational about its longitudinal axis without being off-set axially.

20 Claims, 3 Drawing Sheets

(56) References Cited

U.S. PATENT DOCUMENTS 6,073,861 A * 6/2000 Wright et al. ..... 239/114
6,378,791 B1 * 4/2002 Perry et al. ..... 239/566
7,617,990 B2 * 11/2009 Huffman ..... 239/123
2005/0263620 A1 * 12/2005 Prieto et al. ..... 239/465
2006/0163389 A1 * 7/2006 Struck ..... 239/550

* cited by examiner

NOZZLE ARRANGEMENT

CROSS-REFERENCE TO RELATED APPLICATIONS

This application claims the benefit of German Patent Application No. 10 2010 019 179.5, filed Apr. 30, 2010, which is incorporated herein by reference as if fully set forth.

BACKGROUND

The invention relates to a nozzle arrangement to be provided at a high-pressure-cleaning or conditioning device of a paper machine with a nozzle body, comprising a first jet channel for passing a liquid impinged with high pressure, with at least one nozzle element being arranged in the jet channel, at least partially penetrating it and forming the liquid passing the jet channel into a laminar jet.

In paper machines, high-pressure cleaning or condition devices are operated in the form of high-pressure spray tubes, installed for example perpendicular in reference to the so-called X-axis forming the operating direction of the paper machine, and oscillating perpendicularly in reference to said axis, with their objective being the continuous cleaning and/or conditioning of sheet forming sieves, press felts, drying belts, and roller surfaces. Other forms of cleaning devices may be embodied as so-called traversing cleaners, which can be moved along the couch squirt of the paper machine, for example, and are used for cleaning grills or other equipment in different production sections of the paper machine. Here, water is used at an operating pressure ranging from 10 to 50 bar, which is called high-pressure.

The so-called high-pressure spray tubes are equipped with radially installed high-pressure jet nozzles, i.e. so-called needle-jet nozzles or HP-nozzles. These HP-nozzles emit a water jet which is also called a full jet or needle-shaped jet and essentially shows a circular cross-section.

To this extent, the nozzle arrangements mentioned at the outset are known, for example from DE 20 2005 020 149, with their primary feature being the creation of a water jet having a jet—laminarity as good as possible. It is characterized in the jet not disintegrating into individual drops before impingement. This is primarily achieved by the production of the channel being performed with great precision. From DE 10 2006 007 223 A1 it is also known that a multitude of nozzle elements can be arranged at a nozzle body, by which a multitude of jets shall create a jet area in order to increase the planar performance of the nozzle arrangement. The nozzle body is here fixed with regards to its nozzle arrangement using an external thread as the fastening.

For economic and ecological reasons, the reduction of the water consumption is one of the most pressing topics in the paper industry. An important measure, here, is the reduction of the diameter of the jet of HP-nozzles, and thus the reduction of the volume flow, however, simultaneously here the cleaning result may not be compromised. In order to achieve higher production performance and a better paper quality, the efficiency of the HP-spray tubes must be constantly improved, which largely depends on the nozzles.

SUMMARY

Therefore the objective of the present invention is to provide a nozzle arrangement, which in a more flexible arrangement further increases the efficiency of HP-spray tubes by a good cleaning result with simultaneously reduced water consumption.

This object is attained with a nozzle arrangement of the type mentioned at the outset, in which at least one additional nozzle element is provided at the nozzle body, which is arranged respectively in another jet channel different from the first jet channel or together with the first and/or another nozzle element in a joint jet channel and that the nozzle body is arranged rotational around its longitudinal axis at the nozzle arrangement, without any axial off-set.

Due to the fact that at a nozzle arrangement several jet channels and/or nozzle elements are provided, they can be embodied with a smaller diameter, which on the one hand reduces the volume flow itself, two nozzle elements consume approximately 60% of the volume of a single nozzle element, with its diameter being equivalent to the sum of two nozzle elements, with three jets showing 40% of the diameter of a larger jet resulting in a reduction of the volume flow by half.

Additionally, the water consumption is reduced because the nozzle body can be optimally adjusted by being rotational around the longitudinal axis with regards to the direction of operation of the paper machine, and this way a clearly optimized setting can be achieved. The nozzle body is here rotational in principle, however rotationally fixed during the operation of the nozzle arrangement.

With regards to the arrangement of jet channels and nozzle elements at the nozzle arrangement according to the invention various embodiments are possible showing different further developments of the invention. In one of them, the rotational nozzle body may comprise two or three nozzle elements, each allocated to a separate jet channel or allocated to a joint jet channel.

In another embodiment of the nozzle arrangement the nozzle body may have an essentially circular cross-section and the jet channels and/or nozzle elements may be arranged on a straight line intersecting the center of a circle, for example in a configuration symmetrical in reference to the center of a circle, which allows a simple adjustment of the arrangements in reference to each other for various outlet opening.

In another embodiment of the nozzle arrangement, at least two jet channels and/or nozzle elements in the nozzle body may be arranged at an equal distance from different sides of the center of the circle and in case of an odd number of jet channels and/or nozzle elements one of them may be in the center of the circle. For example, if the straight line on which the nozzle elements are arranged extends with regards to their alignment in the direction of the X-axis of the paper machine, a number of successive jets can be achieved equivalent to the number of jet channels and/or nozzle elements.

Similarly advantageous, by the arrangement of the nozzle elements, being aligned perpendicularly in reference to the X-axis, perhaps a wider area can be covered by a single nozzle arrangement, which can increase the cleaning intensity of the spray tube.

In other advantageous further developments of the nozzle arrangement according to the invention the longitudinal axes of the jet channels and/or nozzle elements may form the same or a different angle each with the longitudinal axis of the nozzle body.

In other advantageous further embodiments of the nozzle arrangement according to the invention at least the majority of the jet channels and/or nozzle elements may have the same or different channel diameters in reference to each other.

When the nozzle arrangement according to the invention comprises approximately two nozzle elements and perhaps the same number of jet channels it can emit two water jets arranged parallel or at an angle in reference to each other and thus it yields higher cleaning and/or conditioning performance at sieves, felts, and rollers of a paper machine that nozzle arrangements comprising only one nozzle element. The position of the water jet can be adjusted such that they are arranged behind each other in the X-direction as well as side-by-side, and any location between these two positions. With these means for manipulation it is possible, when the jets are arranged perpendicularly in reference to the X-axis of the machine, to double the total number of jets emitted by the spray tube, which results in an increase of the cleaning and/or conditioning performance of the spray tube, with additionally the jets may exit at an angle in reference to the Z-axis, which results in an increase of the cleaning and/or conditioning performance of the spray tube and a more thorough cleaning of dual-layer sheet formation sieves. In an arrangement of the jets in the X-axis, an increase of the cleaning and/or conditioning performance of each individual jet can be achieved. With the arrangement of the jets in the X-axis or perpendicularly in reference to the X-axis, by the use of smaller nozzle elements and an appropriately reduced jet diameter and/or when the number of jets is doubled an adequate cleaning and conditioning performance of the nozzle can be achieved with a significantly reduced water consumption, with for example, as already mentioned, the volume flow of two jets having a diameter of 0.5 mm with the same water pressure being equivalent to only approximately 60% of the volume flow of a jet having a diameter of 1.0 mm, for example.

The nozzle elements of the nozzle arrangement according to the invention may advantageously form, in different embodiments, a section at the influx side of the jet channel or channels and here either be formed by a penetrating opening of the respective section of the nozzle body itself or as a part inserted into the respective jet channel having a penetrating opening. In the first of the two cases, the opening at least partially penetrating the nozzle body itself therefore forms the nozzle element, while in the second case an insert is formed, inserted in this section and preferably impressed into a precisely matching receiver of the nozzle body. In both cases the nozzle element opens downstream into the allocated jet channel, which may also be a joint channel.

In order to allow an optimally laminar jet for an extended period of time the insert of a further embodiment of the nozzle arrangement is advantageously made from a hard, low-wear material, such as ruby, sapphire, diamond, ceramics, hard metal, or any similarly hard material.

Here, the laminar liquid jets created by the nozzle elements of the nozzle arrangement according to the invention, particularly water jets, in the sense of a considerable reduction of the volume flow of liquids, represent jets having a diameter ranging from 0.1 mm to 1.2 mm, preferably from 0.2 mm to 0.9 mm, particularly preferred from 0.3 mm to 0.6 mm.

In order to allow a simple transfer of the nozzle body from a first operational position into one or more operational positions in another further development of the nozzle arrangement a tool is allocated to the nozzle body comprising an engagement element by which the nozzle body can be rotated around its longitudinal axis.

In another beneficial further development of the nozzle arrangement particularly advantageous for several jet channels, the engagement element for rotating the nozzle body may engage at least one opening of the nozzle body, preferably embodied slot-shaped for this purpose, or at least two outlet openings of the jet channels. For the slot-shaped opening of the nozzle body, which beneficially can be inserted into jet channels not extending parallel in reference to the axis of the nozzle body, the tool may be provided with an engagement element similar to the blade of a screwdriver, while in axially parallel, particularly in essentially cylindrical jet channels, the tool comprises a complementary cylinder parts as the engagement element.

For a simple operation of the nozzle arrangement when placing and removing it from the outlet openings of the respective spray tube, depending on the embodiment of the receivers at the cleaning device, for example at a spray tube, in another further development of the device the nozzle body may form an insert made from a metallic material, received in a carrier.

In order to allow mounting the nozzle arrangement at the respective cleaning device in an easy and secure fashion, it may be advantageous in a further development to provide a contact at the carrier, coaxial in reference to the longitudinal axis of the nozzle body, with its cross-section covering the jet paths of the laminar jets of the nozzle elements over the height of the carrier so that the jets can exit the carrier unhindered.

Simultaneously, in another further development, advantageously a groove may be inserted into the contact of the carrier and further a tool, for example a hexagon socket, may be allocated to the nozzle arrangement which comprises a spring-loaded holding means, for example one or more balls engaging said groove. This way the nozzle arrangement is held and cannot fall off the tool.

Here, preferably the carrier may be embodied as a platelet or as an essentially cylinder-symmetrical body having at least one catch for the engagement of a tool, for example such that a longitudinal section with a closed exterior contour forms a polygon exhibiting six corners, so that a tool like a wrench can easily engage it or that this section shows a hexagonal recess for the insertion of an Allen key.

One embodiment of the nozzle arrangement allows a particularly simple fixation in an outlet opening of a cleaning device formed as a spray tube by way of screwing in, with the carrier for this purpose being provided with a fixation means in the form of a threaded section, here particularly the carrier may be provided with an external thread to accept an internal thread allocated thereto and located at the outlet opening. However, it is also possible for the carrier to be embodied with an internal thread for an external thread to be screwed upon it, embodied like a cap nut.

In order to securely hold the nozzle body as an insert in its operational position during use and to prevent leakage, the insert may be fixed in the carrier by a fixation element and sealed by a sealant. The sealant may here represent an annular gasket and the securing element a pre-stressed locking ring.

In another advantageous embodiment of the nozzle arrangement, it may be possible to impinge it at its inlet side, including the inlet openings of the nozzle elements, with a cleaning tool so that undesired contaminations of these nozzle openings, caused by particles in the jet medium used, can easily and safely be removed by the respective cleaning tool arranged inside the spray tube, for example a rotating brush. Here, at the nozzle arrangement advantageously an inlet channel arranged upstream in reference to the nozzle element can be waived.

BRIEF DESCRIPTION OF THE DRAWINGS

In the following the invention is explained in greater detailed using the exemplary embodiments of the drawing. The partially very schematic drawing shows.

DETAILED DESCRIPTION OF THE PREFERRED EMBODIMENTS

Figure 1:
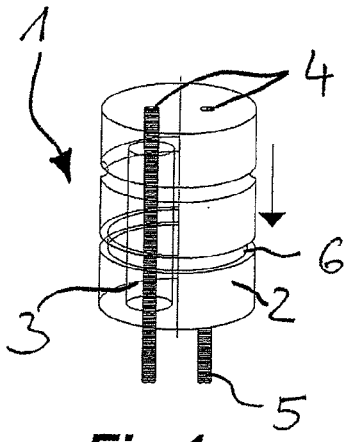
FIG. 1 is a perspective, partially transparent side view of a first exemplary embodiment of the nozzle body with two nozzle elements and allocated jet channels to create two parallel water jets.

In FIG. 1, first a nozzle arrangement is discernible, in its entirety marked 1, with the outlet opening of a spray tube, allocated to a cleaning device for a paper machine, in which the nozzle arrangement 1 is arranged, which is not shown for reasons of clarity. The nozzle arrangement 1 comprises a nozzle body 2, showing two jet channels 3 for liquids impinged with high pressure passing through it. One nozzle element 4 each is arranged in both jet channels 3, forming the liquid passing through the jet channel 3 into a laminar jet.

The nozzle body 2 of the nozzle arrangement 1 is provided rotational about its longitudinal axis, resulting in a different spatial arrangement of the nozzle element 4 and/or the jet channels 3 allocated thereto in reference to the first position, leading to a different jet alignment of the jets 5. In FIG. 1 the nozzle body 2 essentially comprises a cylindrical form and is provided with circumferential grooves 6 at two levels of the cylinder body, which grooves can be engaged by circumferential projections provided at the interior wall of a carrier, not shown, when the nozzle arrangement is used as an insert. These grooves serve, on the one hand, as mechanical fasteners of the nozzle body in the carrier, and on the other hand as seals.

At the upper inlet side of the nozzle body 2, the liquid enters the nozzle elements 4, forming laminar jets 5, which after exiting the respective nozzle element 4 pass through the downstream section of the jet channel 3, with its down-stream section forming the nozzle elements 4. Accordingly, the jets 5 pass through the nozzle body 2 in the direction indicated by the arrow.

Figure 2:
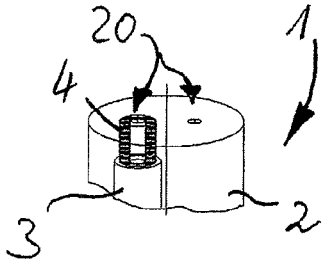
FIG. 2 is a perspective, partially transparent side view of an inlet section of another exemplary embodiment of the nozzle arrangement with nozzle elements formed by inserts to create two parallel water jets.

In FIG. 2, the inlet area of the nozzle body 2 of another nozzle arrangement 1 is discernible, in which the nozzle elements 4 are formed by inserts 20 made from a very hard material, forming a precisely laminar jet, not shown, and being subject to only minor wear. Here, too, the formation of the jets 5 is respectively followed by them passing through the downstream section of the jet channel 3.

Figure 3:
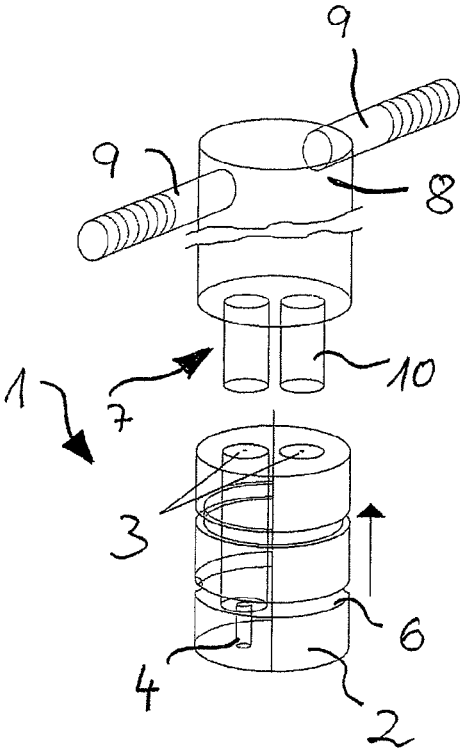
FIG. 3 is a perspective, partially transparent side view of the nozzle body to create two parallel water jets of FIG. 1 with an allocated tool to rotate the nozzle body in order to create two parallel water jets.

In FIG. 3, in the lower part of the figure, a nozzle body 2, equivalent to the one in FIG. 1, is discernible in a position rotated by 180° about the lateral axis, in which therefore the direction of flow as indicated by the arrow, of the jets, not shown, points upwards for the viewer. A tool 7 is discernible above the nozzle body 2, which comprises an annular shaft 8 and two engaging sections arranged at the shaft 8 at opposite areas. At the end of the shaft 8 of the tool 7, facing the downstream face of the nozzle body 2, two pin-shaped engagement elements 10 project in the direction of the nozzle body 2, provided to engage the jet channels 3 and allowing via said engagement rotation of the nozzle body 2 about its longitudinal axis.

Figure 4:
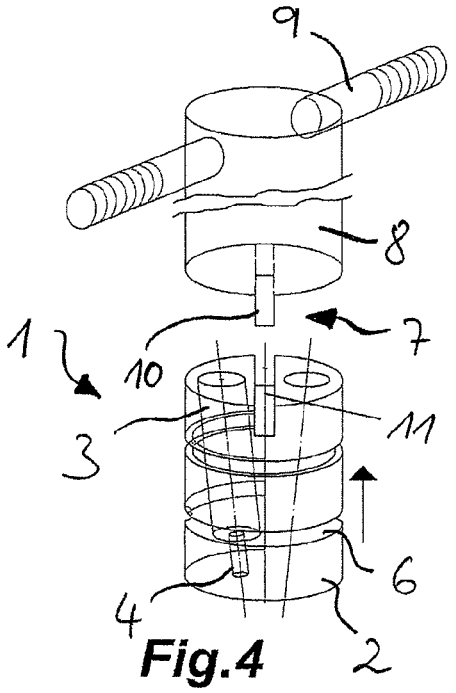
FIG. 4 is a perspective, partially transparent side view of another exemplary embodiment of the nozzle arrangement with jet channels and nozzle elements not extending coaxially in reference to the longitudinal axis of the nozzle body to create two water jets, each of which forming an acute angle with the longitudinal axis of the nozzle body.

The illustration of FIG. 4 differs from the one of FIG. 3 essentially in three features. First, the jet channels 3 are arranged extending diagonally in the nozzle body 2 because their longitudinal axes form an acute angle with the longitudinal axis of the nozzle body 2, with an otherwise identical channel diameter. The nozzle body shows a slot-shaped contact 11, which is engaged by a blade located at the corresponding tool 7 by an appropriate positioning of the tool 7 for rotating the nozzle body 2. In order to better show this circumstance the lower part of the annular shaft 8 with the engaging sections 9 of the tool 7 in FIG. 4 is shown in a modified perspective view.

Figure 5:
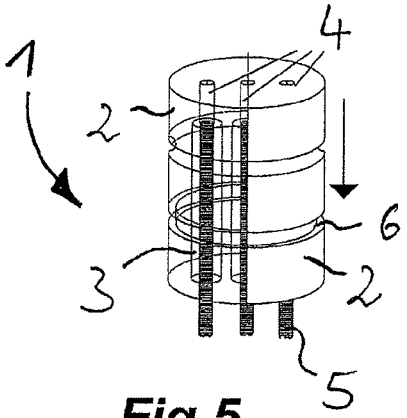
FIG. 5 is a perspective, partially transparent side view of another exemplary embodiment of the nozzle arrangement having three nozzle elements and jet channels parallel in reference to the longitudinal axis of the nozzle body to create three parallel water jets.
Figure 6:
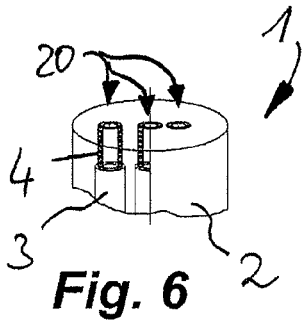
FIG. 6 is a perspective, partially transparent side view of another exemplary embodiment of the nozzle arrangement, similar to the one shown in FIG. 5, having nozzle elements formed by inserts to create three parallel water jets.
Figure 7:
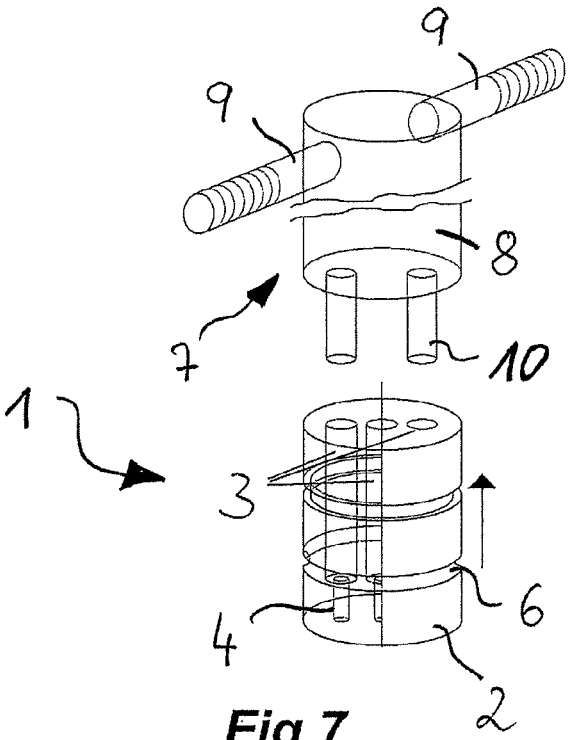
FIG. 7 is a view of the exemplary embodiment of FIG. 5 with an allocated tool for rotation.

FIGS. 1 through 4 show the nozzle body 2 of a nozzle arrangement having two nozzle elements 4 and two jet channel openings at its downstream end, arranged at an equal distance from the center of the circle on a straight line passing through the circle of the face of the nozzle body 2, and FIGS. 5 through 7 show a nozzle arrangement 1 with three jets 5 extending parallel in reference to the longitudinal axis of the nozzle body. Here, the nozzle elements 4 of FIG. 5 are equivalent to those in FIG. 1, those of FIG. 6 to those of FIG. 2, and the illustration of FIG. 7 with three nozzle elements and jet channels is equivalent to that of FIG. 3. In FIGS. 5 through 7, each jet channel 3 is also allocated to a separate nozzle element 4 to form jets, the openings of the jet channels 3 at the down-stream annular face of the nozzle body 2 are once more arranged on a straight line intersecting the circle, with the two exterior openings of the jet channels 3 showing the same distance from the one located in the center. Further, there may be differences with regards to the diameter of the jets 5 created by the nozzle elements 4 and the diameter of the jet channels. Therefore, the diameter of the engaging element 10 arranged at the tool of FIG. 7 is different, too, with instead of three jet channels, accordingly only the two engagement means are arranged projecting from the tool 7 necessary to rotate the nozzle body, which can engage the two exterior jet channels 3.

Figures 8A, 8B, 8C:
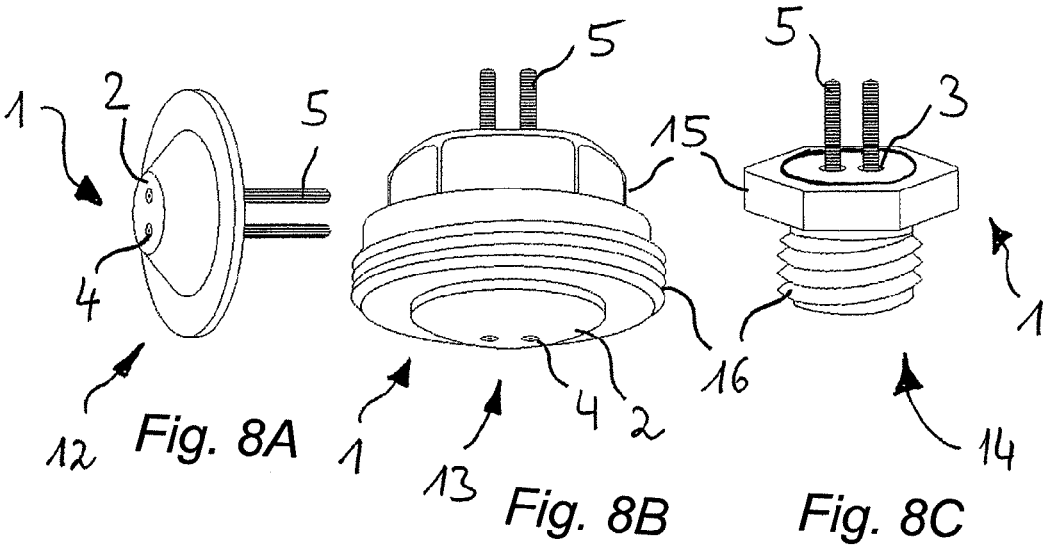
FIGS. 8A-8C shows perspective side views of the exemplary embodiment of the nozzle arrangement of FIGS. 1 and 3, received in various carriers, to create two parallel water jets.
Figures 9A, 9B, 9C:
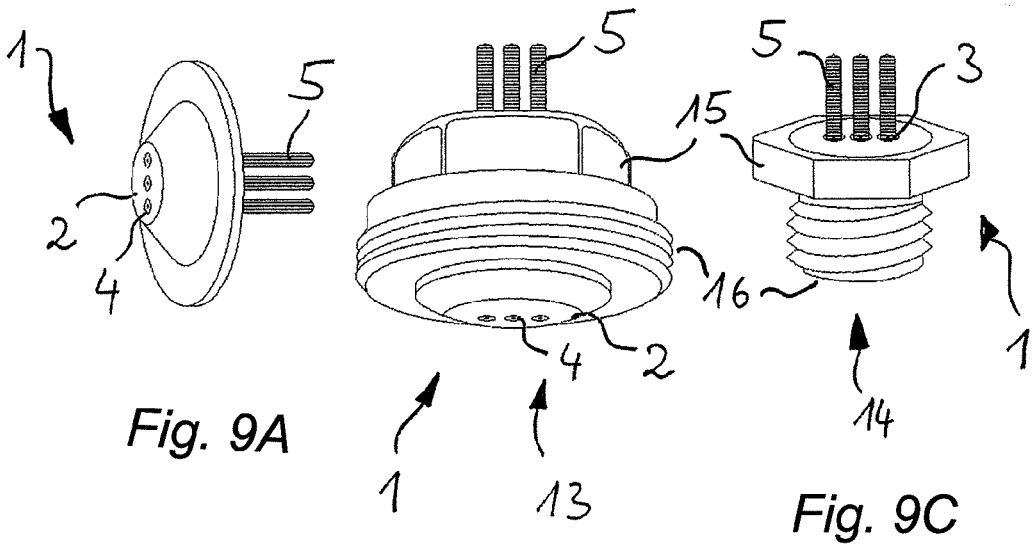
FIGS. 9A-9C shows perspective side views of the exemplary embodiment of the nozzle arrangement of FIGS. 5 and 7, received in various carriers, to create three parallel water jets.

In FIGS. 8A-C and 9A-C the jet bodies 2 are arranged as inserts in various carriers 12, 13, 14 having two jets 5 (FIG. 8) and three jets 5 (FIG. 9), in which the left carrier 12 forms a so-called platelet nozzle, in which the nozzle body 2 accepts the jet channels 3 and/or the nozzle elements 4, and after passing them the jets 5, not discernible in the illustration of FIGS. 8 and 9, entering individual or joint channels. The central and right carriers 13, 14 are each formed in FIGS. 8 and 9 as essentially cylinder-symmetric bodies and comprise a contact 15 for the engagement of a tool in the form of a hexagonal wrench or a contact for an engagement by a tool in the form of an Allen socket, not shown, as well as an external thread 16 to arrange the nozzle arrangement 1 in outlet openings, not shown, of the spray tube of a cleaning device of a paper machine, with in the illustrations of FIGS. 8 and 9 the threaded sections 16 being arranged at the nozzle arrangements 1 at the inlet side and the contacts 15 at the outlet side, in order to allow access from the outside in the sense of assembly or disassembly. Additionally, the threaded section 16 of the central carrier 13 shows a greater diameter than the contact 15, while the opposite applies to the right carrier 14. Furthermore, due to the respective perspective, the inlet sides of the nozzle body 2 with the nozzle elements 4 of the jet channels 3 are better visible in the left and central carriers 12, 13, while in the right carrier 14 the down-stream openings of the jet channels 3 are better visible. Not shown in FIGS. 8 and 9 is the annular fastening element, holding the nozzle body of the nozzle arrangement in its operational position during use, as well as the also annular sealant for sealing the arrangement.

The above-described invention therefore relates to a nozzle arrangement 1 to provide a high-pressure cleaning or conditioning device of a paper machine with a nozzle body 2, comprising a first jet channel 3 for passing liquid impinged with high pressure, with the jet channel 3 comprising at least one partially penetrating nozzle element 4, forming the liquid passing through the jet channel 3 into a laminar jet 5. In order to obtain a nozzle arrangement 1 increasing the efficiency of the spray tube by a good cleaning result under reduced water consumption it is provided according to the invention that at least one additional nozzle element 4 is provided at the nozzle body 2, which is arranged at another jet channel 3, different from the first jet channel 3, or together with the first and/or another nozzle element 4 arranged in a joint jet channel 3 and that the nozzle body 2 at the nozzle arrangement 1 is arranged rotational about its longitudinal axis without any axial off-setting.

The invention claimed is:

1. A nozzle arrangement for a high-pressure cleaning or conditioning device of a paper machine, the nozzle arrangement comprising a nozzle body, having a first jet channel adapted for passing liquid impinged with high pressure, at least one nozzle element being arranged in the jet channel and at least partially penetrating the jet channel that is adapted to form the liquid passing therethrough into a laminar jet, at least one additional nozzle element (4) is provided in the nozzle body, which is respectively arranged in another jet channel (3) different from the first jet channel (3), and the nozzle body (2) is arranged in the nozzle arrangement (1) freely rotational about a longitudinal axis without any axial off-set.

2. The nozzle arrangement according to claim 1, wherein the nozzle body (2) comprises two or three of the nozzle elements (4), with a separate jet channel (3) or a joint jet channel (3) being respectively allocated thereto.

3. The nozzle arrangement according to claim 1, wherein the nozzle body (2) has an essentially annular cross-section and the nozzle elements (4) are arranged on a straight line intersecting a center of the cross-section.

4. The nozzle arrangement according to claim 3, wherein at least two of the nozzle elements (4) and/or jet channels (3) of the nozzle body (2) are arranged at different sides with a same distance from the center of the cross-section and with one of the nozzle elements being located in a center of the cross-section if a number of nozzle elements (4) is odd.

5. The nozzle arrangement according to claim 1, wherein a longitudinal axis and/or longitudinal axes of the jet channel or channels (3) and/or nozzle elements (4) are arranged parallel in reference to the longitudinal axis of the nozzle body (2).

6. The nozzle arrangement according to claim 1, wherein longitudinal axes of the jet channels (3) and/or nozzle elements (4) form the same or different angles with the longitudinal axis of the nozzle body (2).

7. The nozzle arrangement according to claim 1, wherein at least the majority of jet channels (3) and/or nozzle elements (4) respectively have the same channel diameters in reference to each other.

8. The nozzle arrangement according to claim 1, wherein the nozzle elements (4) form a section at an inlet side of the jet channel or channels (3) and here are either formed by a penetrating opening of a respective section of the nozzle body (2) itself or as an insert (20) having a penetrating opening that is received in the jet channel (3).

9. The nozzle arrangement according to claim 8, wherein the insert (20) is made from ruby, sapphire, diamond, ceramics, hard metal, or a similarly hard material.

10. The nozzle arrangement according to claim 1, wherein the nozzle elements (4) each create a laminar jet having a diameter ranging from 0.1 mm to 1.2 mm.

11. The nozzle arrangement according to claim 1, wherein a tool (7) is allocated to the nozzle arrangement (1), which comprises an engagement element (10) by which the nozzle body (2) can be rotated about the longitudinal axis.

12. The nozzle arrangement according to claim 11, wherein the engagement element (10) for rotating the nozzle body (2) engages at least one slot-like opening (11) of the nozzle body (2) provided for that purpose or at least two outlet openings of the jet channels (3).

13. The nozzle arrangement according to claim 1, wherein the nozzle body (2) forms an insert made from a metallic material, which is insertable into a carrier (12, 13, 14).

14. The nozzle arrangement according to claim 13, wherein the insert is held in the carrier (12, 13, 14) by a fastening element.

15. The nozzle arrangement according to claim 1, wherein an inlet side including inlet openings of the nozzle elements (4) is adapted to be impinged by a cleaning device.

16. The nozzle arrangement according to claim 1, wherein a longitudinal axis or axes of the jet channels (3) respectively form an acute angle with the longitudinal axis of the nozzle body (2).

17. A nozzle arrangement for a high-pressure cleaning or conditioning device of a paper machine, the nozzle arrangement comprising a nozzle body, having a first jet channel adapted for passing liquid impinged with high pressure, at least one nozzle element being arranged in the jet channel and at least partially penetrating the jet channel that is adapted to form the liquid passing therethrough into a laminar jet, at least one additional nozzle element (4) is provided in the nozzle body, which is either respectively arranged in another jet channel (3) different from the first jet channel (3) or arranged in a joint jet channel (3), and the nozzle body (2) is arranged in the nozzle arrangement (1) freely rotational about a longitudinal axis without any axial off-set wherein the nozzle body (2) forms an insert made from a metallic material, which is insertable into a carrier (12, 13, 14) and a contact is provided at the carrier (12, 13, 14), coaxial in reference to the longitudinal axis of the nozzle body, with a cross-section of the carrier covering flow paths of laminar jets (5) of the nozzle elements (4) over a height of the carrier (12, 13, 14).

18. The nozzle arrangement according to claim 17, wherein a groove is located in the carrier (12, 13, 14), and a tool is allocated to the nozzle arrangement (1), which comprises an engagement element to engage the groove in a detachable fashion.

19. The nozzle arrangement according to claim 18, wherein the carrier (12, 13, 14) is embodied as a platelet (12) or shows an essentially cylinder-symmetric body (13, 14) with at least one contact surface (15) for the engagement of a tool.

20. The nozzle arrangement according to claim 19, wherein the carrier (12, 13, 14) comprises a fastening section (16).

* * * * *